US005306527A

United States Patent [19]

Kurz et al.

[11] Patent Number: 5,306,527

[45] Date of Patent: Apr. 26, 1994

[54] METHOD OF COATING MULTILAYER PHOTOGRAPHIC ELEMENTS WITH REDUCED RIPPLE DEFECTS

[75] Inventors: Mark R. Kurz, Rochester; Steven J. Weinstein, Fairport; Kenneth J. Ruschak, Rochester, all of N.Y.

[73] Assignee: Eastman Kodak Company, Rochester, N.Y.

[21] Appl. No.: 868,829

[22] Filed: Apr. 14, 1992

[51] Int. Cl.[5] ..... B05D 1/30

[52] U.S. Cl. ..... 427/420; 118/DIG. 4

[58] Field of Search ..... 427/420; 118/DIG. 4

[56] References Cited

U.S. PATENT DOCUMENTS

| | | | |
|---|---|---|---|
| 3,973,062 | 8/1976 | Fahrni | 427/420 |
| 4,384,015 | 5/1983 | Koepke et al. | 427/420 |
| 4,415,610 | 11/1983 | Choinski | 427/372.2 |
| 4,569,863 | 2/1986 | Koepeke et al. | 427/402 |
| 4,572,849 | 2/1986 | Koepke et al. | 427/420 |

*Primary Examiner*—Shrive Beck
*Assistant Examiner*—Katherine A. Bareford
*Attorney, Agent, or Firm*—Nixon, Hargrave, Devans & Doyle

[57] ABSTRACT

A method for reducing the tendency toward the formation of ripple imperfections in the coating of a plurality of layers of liquid photographic compositions or moving webs is disclosed. Conditions for coating the compositions are determined according to a given formula to keep the ripple value below 35. The coating compositions are formed into a laminar flow of a plurality of distinct layers including the photographic compositions as upper, middle, and lower layers. The flowing plurality of layers is then received as a layered mass on a moving web. A method for predicting the tendency toward the formation of ripple imperfections in the coating of a multilayer photographic element is also disclosed.

16 Claims, 4 Drawing Sheets

METHOD OF COATING MULTILAYER PHOTOGRAPHIC ELEMENTS WITH REDUCED RIPPLE DEFECTS

FIELD OF INVENTION

The present invention relates to an improved method of coating multilayer liquid packs on moving webs. More particularly, the present invention relates to a method for reducing the likelihood of ripple imperfections in the coating of multilayer photographic elements.

BACKGROUND OF THE INVENTION

In many instances it is desired to Coat the surface of an object with a plurality of distinct, superposed layers (collectively, the plurality of layers is also known as a coating pack). For example, a common commercial operation involves application of a plurality of paint coatings to an article. Another common example is the manufacture of photographic elements, such as photographic film or paper, wherein a number of layers (up to ten or more) of different photographic coating compositions must be applied to a suitable support in a distinct layered relationship. The uniformity of thickness of each layer in the photographic element must be controlled within very small tolerances.

Common methods of applying photographic coating compositions to suitable supports involve simultaneously applying the superposed layers to the support. Typically, a coating pack having a plurality of distinct layers in face-to-face contact is formed and deposited on the object so that all the distinct layers are applied in a single coating operation. In the photographic industry, several such coating operations may be performed to produce a single photographic element. Several methods and apparatus have been developed to coat a plurality of layers in a single coating operation One such method is by forming a free falling, vertical curtain of coating liquid which is deposited as a layer on a moving support. Exemplary "curtain coating" methods of this type are disclosed in U.S. Pat. Nos. 3,508,947 to Hughes, 3,632,374 to Grieller, and 4,830,887 to Reiter.

"Bead coating" is another method of applying a plurality of layers to a support in a single coating operation. In typical bead coating techniques, a thin liquid bridge (a "bead") of the plurality of layers is formed between, for example, a slide hopper and a moving web. The web picks up the plurality of layers simultaneously, in proper orientation, with substantially no mixing between the layers. Bead coating methods and apparatus are disclosed, for example, in U.S. Pat. Nos. 2,681,294 and 2,289,798.

In both bead coating and curtain coating methods, it is necessary to set and/or dry the layered coating after it has been applied to the support. To accomplish this, the web is typically conveyed from the coating application point to a chill section. Subsequently, the web is conveyed through a series of drying chambers after which it is wrapped on a winder roll. Space constraints for the coating machine, cost considerations, and flexibility of design may dictate that one or more inclined web paths be present in conveying the coated substrate from the coating point to the chill section and drying chambers.

Advancements in coating technology have led to increased numbers of layers coated at each coating station, increased total pack thickness per station, thinner individual layers, use of rheology-modifying agents, and the development of new, sophisticated chemistries. In addition, a multilayer photographic coating can consist of sensitizing layers and/or additional, non-imaging, layers. As a result, the chemical composition of the multilayer coating pack is often markedly different from one layer to the next.

In accordance with the present invention, it has been discovered that the above-mentioned factors, in conjunction with the use of web paths implementing vertical components (inclines) has led to the development of a certain, specific nonuniformity in the coated layers. It has been found that this nonuniformity, referred to herein as "ripple" or "ripple imperfection", is caused by interfacial wave growth in the flow of a multilayer coating on the web. Ideally, the flow of the layers on the web is plug (i.e., all layers, as well as the web, are moving at the same speed). However, it has been found in accordance with the present invention that inclined web conveyance paths facilitate a gravity-induced flow of the layers relative to the web. This gravity-induced flow supports the existence of waves which increase in amplitude as the layers translate with the web. It is believed that this wave growth is manifested as "ripple".

The causes of and solutions to the problem of ripple imperfections in multilayer coatings have gone largely unexplored. The present invention addresses this problem and discloses a method of reducing the likelihood and severity of ripple formation in coating multilayer liquid packs.

SUMMARY OF THE INVENTION

In accordance with the present invention, it has been discovered that ripple imperfections can occur in multilayer coating packs when there are viscosity differences between adjacent layers after coating those layers on a moving web. These viscosity differences can arise on the web even when delivered viscosities (i.e., viscosities before coating on the web) are equal. Post-coating viscosity shifts can be caused, for example, by interlayer mass transport of solvents between layers or from thermal effects. It is believed, in accordance with the present invention, that an osmotic pressure difference between adjacent layers drives interlayer water diffusion in gelatin-containing multilayer coating packs, such as commonly used in the photographic industry. In many cases, osmotic pressure differences may result from significant differences in the layer concentrations of gelatin and other addenda. The effect of gelatin concentration differences is discussed further in our copending U.S. application Ser. No. 07/868,827 entitled "Minimization of Ripple by Controlling Gelatin Concentration", filed on Apr. 14, 1992, and commonly assigned.

In accordance with the present invention it has been determined that the tendency of a multilayer coating pack to exhibit ripple imperfections can be quantified according to the following formula:

$$X = \frac{(\rho)(g)(d_T)(L_{VT})}{2\mu(V_w)},$$

wherein X is the ripple value. $\rho$ is the critical density of the plurality of layers to be coated. The critical density is defined as the density of the coating layer having the highest density. g is a constant representing acceleration due to gravity. $d_T$ is the total thickness of the plurality of layers. $L_{VT}$ is the total vertical component of the web path from the coating application point to the set point. $\mu$ is the critical viscosity of the plurality of layers. The critical viscosity is defined as the viscosity of the layer having the lowest viscosity. $V_W$ is the speed of the moving web over the web path between the coating application point to the set point.

One embodiment of the present invention is a method of reducing the tendency toward ripple formation in the coating of a plurality of layers on a moving web. This method includes the steps of determining coating conditions for coating liquid compositions as a plurality of layers on a moving web in accordance with the above-described formula wherein X is less than 35, preferably 20, and then forming a laminar flow of the plurality of layers in accordance with the determined conditions. The plurality of layers is received as a layered mass on the moving web.

The coating conditions are preferably determined by measuring and/or determining the critical density and viscosity of the plurality of layers, total vertical component of the web path and web speed and then calculating ripple value X. Ripple value X can then reduced to a value less than 35, preferably 20, by adjusting one or more conditions selected from the group consisting of the critical density, critical viscosity, total vertical web distance, web speed, and total thickness of the layered mass.

In an alternative embodiment of the present invention, ripple imperfections are first detected in an existing layered mass. The coating conditions are then adjusted according to the above-described formula to reduce ripple value X. Preferably, ripple value X is reduced to a value below 35, most preferably below 20. A laminar flow of the layered mass is formed and then received as a layered coating on a moving web.

In a third embodiment of the present invention, a method for predicting the tendency of a layered mass to exhibit ripple imperfections is disclosed. This method includes the steps of defining proposed coating compositions for a layered mass to be received by a moving web. Next, the variables of the above-described formula are measured and determined and, using these values, ripple value X is determined. If ripple value X is greater than 75, the layered mass is likely to exhibit ripple imperfection.

The present invention enables the design and use of coating compositions that exhibit a reduced tendency toward the formation of ripple imperfections. The present invention helps obviate a significant coating problem that will become increasingly prevalent, especially in the photographic industry, as any or all of the following coating conditions are implemented: increasing numbers of layers coated at each coating station, increasing total pack thickness, thinner individual layers, use of rheology-modifiers, or development of new, sophisticated chemistries.

DETAILED DESCRIPTION OF THE INVENTION

Figure 1:
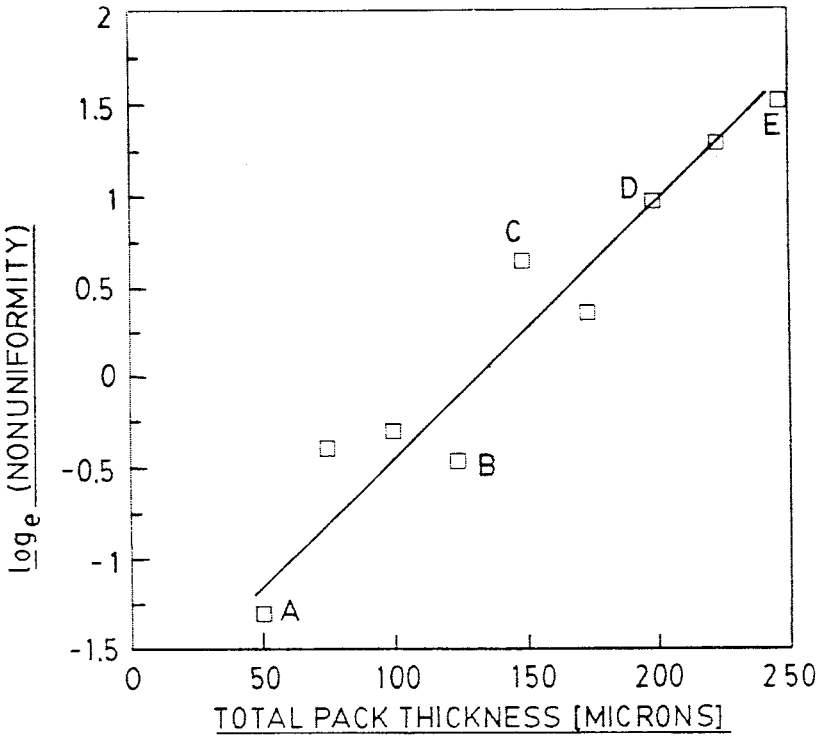
FIG. 1 is a graph illustrating the effect of total coating pack thickness on ripple severity for a three layer coating pack having a low viscosity middle layer.
Figure 1A:
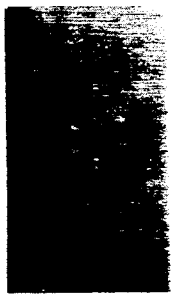
FIGS. 1A, 1B, 1C, 1D, and 1E are a series of photomicrographs illustrating the effect of total coating pack thickness on ripple severity for a three layer coating pack having a low viscosity middle layer.
Figure 1B:
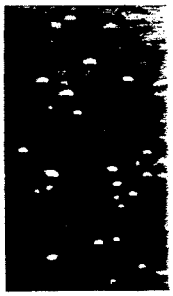

While the invention is specifically described herein with reference to the manufacture of photographic elements, it will be appreciated that it is of much wider application and can be advantageously utilized in numerous fields where it is desirable to effect simultaneous application of three or more distinct superposed layers of liquid.

Ripple or ripple imperfection is defined for the purposes of this invention as a layer thickness nonuniformity resulting from wave growth at the fluid-fluid interfaces of a plurality of layers due to a hydrodynamic instability of the gravity-induced flow of the plurality of layers on a coated web. While not wishing to be bound by theory, it is believed in accordance with the present invention that ripple imperfections arise when there are viscosity differences between adjacent layers of multilayer coating packs. These viscosity differences can be introduced in a variety of ways, including initial viscosity differences between the various layers as delivered to the web or changes in relative layer viscosities from thermal effects after the layers are coated on a web. Another cause may be interlayer mass transport of solvent, for example. One example of this can be seen in the coating of photographic elements, where adjacent layers often contain varying amounts of gelatin. It is thought, in accordance with the present invention, that these differences cause water diffusion between the layers which, in turn, can significantly alter the resulting viscosities of the individual layers after they are coated on the web. In this way, viscosity disparities between layers may be introduced on the web for layers which were originally coated at nominally equal viscosities. The control of ripple by adjusting gelatin percentages is addressed in copending U.S. patent application Ser. No. 07/868,827 entitled "Minimization Of Ripple By Controlling Gelayin Concentration", filed on Apr. 14, 1992, and commonly assigned.

Ripple is manifested by the presence of waves of growing amplitude at the fluid-fluid interfaces between layers of the coated web. In a frame of reference moving with the web, the waves will move along the fluid-fluid interfaces in the direction of the gravity driven flow, while the plurality of layers continues to translate with the web along the conveyance path. Ripple, as described in this invention, is to be contrasted from other potential hydrodynamic instabilities such as those occurring on the hopper slide and the like. The method of the present invention will reduce the likelihood of gravity-driven ripple imperfections in coating multilayer coating packs.

Ripple imperfections occur after the impingement of the plurality of layers as a layered mass on a moving web (the "coating application point") and before the layered mass is substantially set (the "set point"). In other words, the coating compositions comprising the plurality of layers on the moving web must be in a liquid form for ripple to occur. Likewise, it has been discovered in accordance with the present method that ripple only occurs on those portions of the web path (between the coating application point and the set point) that have a vertical component. The direction of the vertical component is irrelevant.

It has also been discovered that certain layer configurations and conditions increase the likelihood of ripple imperfections occurring. For example, there must be at least one internal layer (i.e., a layer having two fluid-fluid interfaces) for ripple to occur. Therefore, the layered mass coated on the moving web must have at least three distinct layers Although the present method is equally applicable to the coating of any number of layers greater than three, the invention will be described in detail with reference to a layered mass having three layers. The "lower" layer is the layer which is in contact with the lower interface of the "middle" or "internal" layer. The "middle" or "internal" layer is the layer having two fluid-fluid interfaces. The "upper" layer is the layer which is in contact with the upper interface of the middle or internal layer. In a three-layer coating, the lower layer is also in contact with the web and the upper layer has a gas-fluid interface. For coatings of more than three layers, the lower and upper layers may be internal as well.

Ripple is more likely to occur if the internal layer is deeper within the layered mass (i.e., closer to the middle of the layered mass). For instance, as the middle layer approaches a nominally central location in the pack, ripple severity increases. Ripple is also more likely to occur if the middle layer is relatively thin as compared to the total thickness of the coating.

Ripple is also more likely when the middle layer has a viscosity significantly higher or significantly lower than the viscosity of both the adjacent layers. For example, a three-layer coating with a middle layer having a viscosity less than 0.8 times the viscosity of the adjacent layer with the lower viscosity, or a three-layer coating with a middle layer whose viscosity is greater than 1.5 times the viscosity of the adjacent layer with the higher viscosity is likely to exhibit ripple.

The present method reduces the likelihood of ripple formation during multilayer liquid coating processes. In one embodiment of the present method, conditions for coating liquid compositions as a plurality of layers on a moving web are first determined in accordance with the formula:

$$X = \frac{(\rho)(g)(d_T)(L_{VT})}{2\mu(V_W)},$$

where X is the ripple value. The lower ripple value X is, the less likely ripple is to occur. To reduce the tendency of ripple imperfection formation according to the present method, ripple value X should be less than 35, and preferably less than 20.

$\rho$ is the critical density of the plurality of layers. The critical density is defined as the density of the coating layer having the highest density.

g is a constant representing acceleration due to gravity (i.e., 9.8 m/sec$^2$).

$d_T$ is the total thickness of the plurality of layers.

$L_{VT}$ is the total vertical distance of the web path from the coating application point to the set point. $L_{VT}$ is an absolute value, i.e., it does not matter if the vertical component is upward or downward. Where the web path includes only one straight section having a vertical component, $L_{VT}$ is equal to $(L)|\sin\beta|$ wherein L is the total length of the web path from the coating application point to the set point and $\beta$ is the angle of inclination of the web path. A web path can have many different sections, being straight and/or curved, having a vertical component. For a curved web path in which an upward moving web turns downward (or vice versa) the web path must be divided into a series of distinct, curved sections. For each distinct, curved section the vertical component of the web motion can be only upward or only downard. If the web path has multiple, differing vertical components, $L_{VT}$ can be determined according to the formula:

$$L_{VT} = \sum_{i}^{n} |L_{vi}|$$

wherein $L_{vi} = L_i|\sin\beta_i|$ for a straight inclined section and $L_{vi}$=the vertical component of a curved conveyance section. i is an integer of one or more, n is the total number of differing sections of the web path, $L_i$ is the length of each individual section having a vertical component, and $\beta_i$ is the angle of inclination of each straight individual section having a vertical component. $L_{VT}/V_W$ is equal to the effective incline residence time ($t_r$). The effective incline residence time is the total time the layered mass would spend on a vertical path as it travels on the web from the coating application point to the set point.

$\mu$ is the critical viscosity of the plurality of layers. The critical viscosity is defined as the viscosity of the coating layer with the lowest viscosity. Because of the difficulty in measuring the viscosity of the layers after they are coated on the moving web, the critical viscosity can be measured either as delivered to the web (i.e., before the layers are coated on the web) or after coating the plurality of layers on the web. If possible, it is preferable to determine the critical viscosity after coating the plurality of layers on the web. For example, in preparing gelatin-containing photographic elements, the measuring can include anticipating the viscosity values of the layers on the web by predicting the extent of water diffusion between adjacent layers.

$V_W$ is the speed of the moving web over the web path from the coating application point to the set point.

Ripple value X is a dimensionless value and, therefore, the above variables should be expressed in consistent units.

To determine the conditions whereby ripple value X is less than 35, any suitable method can be used. The present method is useful either before coating (when determining the make-up of the compositions) or after the layers have been designed. In a preferred embodiment of the present method, the density and viscosity values for each composition of the actual or proposed plurality of layers are measured and critical density $\rho$ and critical viscosity $\mu$ are determined. The total vertical web distance $L_{VT}$ and web speed $V_W$ are determined and the total thickness of the layered mass, $d_T$, is determined. The resulting values are then used to calculate ripple value X according to the formula above. Then, if necessary, any one or more of the coating conditions including critical density, critical viscosity, vertical web distance, web speed, or the total thickness of the layered mass are changed or adjusted to reduce ripple value X to a value less than 35, preferably less than 20.

The variables can be changed by any appropriate method. For example, maintaining the web path from the coating application point to the set point in a substantially horizontal configuration will reduce $L_{VT}$ to zero or near zero and, therefore, reduce ripple value X accordingly. $L_{VT}$ can also be reduced by chill setting the plurality of layers earlier, for example. In addition, earlier chilling can serve to increase $\mu$ for many solutions, particularly aqueous gelatin solutions. $\mu$ can also be increased by adding viscosifying agents or thickeners to one or more layers of the plurality of layers and thereby reduce ripple value X. Ripple value X is also reduced if total thickness $d_T$ is reduced, (i.e., by lowering the number layers to be coated or reducing the aggregate thickness of the plurality of layers). Ripple value X can also be reduced by increasing web speed $V_W$ over the web path between the coating application point and the set point.

To coat the plurality of layers on a moving web, a laminar flow of the plurality of layers, which includes the compositions as upper, middle, and lower layers, is formed in accordance with the determined conditions. Any suitable method of forming a laminar flow of the photographic compositions is suitable. Preferably, the laminar flow of the plurality of layers is formed on an inclined plane on, for example, a slide hopper of the type conventionally used to manufacture photographic elements. Exemplary methods of forming a laminar flow on a slide hopper suitable in the practice of the present method are disclosed in U.S. Pat. Nos. 3,632,374 to Greiller and 3,508,947 to Hughes, the disclosures of which are hereby incorporated by reference.

The flowing plurality of layers is received as a layered mass on the moving web at a coating application point. Various methods of receiving the plurality of layers on the web can be used. Two particularly useful methods of coating the plurality of layers on the web are bead coating and curtain coating. Bead coating includes the step of establishing a thin liquid bridge (i.e., a "bead") of the layered coating compositions between, for example, a slide hopper and the moving web. An exemplary bead coating process comprises forcing the coating compositions through elongated narrow slots in the form of a ribbon and out onto a downwardly inclined surface. The coating compositions making up the plurality of layers are simultaneously combined in surface relation just prior to, or at the time of, entering the bead of coating. The plurality of layers are simultaneously picked up on the surface of the moving web in proper orientation with substantially no mixing between the layers. Exemplary bead coating methods and apparatus are disclosed in U.S. Pat. Nos. 2,761,417 to Russell et al., 3,474,758 to Russell et al., 2,761,418 to Russell et al., 3,005,440 to Padday, and 3,920,862 to Damschroder et al., the disclosures of which are hereby incorporated by reference.

Curtain coating includes the step of establishing a free falling vertical curtain from the flowing plurality of layers. The free falling curtain extends transversely across the web path and impinges on the moving web at the coating application point. Exemplary curtain coating methods and apparatus are disclosed in U.S. Pat. Nos. 3,508,947 to Hughes, 3,632,374 to Greiller, and 4,830,887 to Reiter, the disclosures of which are hereby incorporated by reference.

As indicated above, the method and apparatus of this invention are especially useful in the photographic art for manufacture of multilayer photographic elements, i.e., elements comprised of a support coated with a plurality of superposed layers of photographic coating composition. The number of individual layers can range from three to as many as ten or more. In the photographic art, the liquid coating compositions utilized are of relatively low viscosity, i.e., low-shear viscosities from as low as about 2 centipoise to as high as about 150 centipoise, or somewhat higher, and most commonly in the range from about 5 to about 100 centipoise. Moreover, the individual layers applied must be exceedingly thin, e.g., a wet thickness which is a maximum of about 0.025 centimeter and generally is far below this value and can be as low as about 0.0001 centimeter. In addition, the layers must be of extremely uniform thickness, with the maximum variation in thickness uniformity being plus or minus five percent and in some instances as little as plus or minus one percent and less. In spite of these exacting requirements, the method of this invention is useful since it permits extremely thin, uniform layers to be coated simultaneously in a distinct layer relationship.

The method of this invention is suitable for use with any liquid photographic coating composition and can be employed with any photographic support and it is, accordingly, intended to include all such coating compositions and supports as are utilized in the photographic art within the scope of these terms, as employed herein and in the appended claims.

The term "photographic" normally refers to a radiation sensitive material, but not all of the layers presently applied to a support in the manufacture of photographic elements are, in themselves, radiation sensitive. For example, subbing layers, pelloid protective layers, filter layers, antihalation layers, and the like are often applied separately and/or in combination and these particular layers are not radiation sensitive. The invention includes within its scope all radiation sensitive materials, including electrophotographic materials and materials sensitive to invisible radiation as well as those sensitive to visible radiation. While, as mentioned hereinbefore, the layers are generally coated from aqueous media, the invention is not so limited since other liquid vehicles are known in the manufacture of photographic elements and the invention is also applicable to and useful in coating from such liquid vehicles.

More specifically, the photographic layers coated according to the method of this invention can contain light-sensitive materials such as silver halides, zinc oxide, titanium dioxide, diazonium salts, light-sensitive dyes, etc., as well as other ingredients known to the art for use in photographic layers, for example, matting agents such as silica or polymeric particles, developing agents, mordants, and materials such as are disclosed in U.S. Pat. No. 3,297,446. The photographic layers can also contain various hydrophillic colloids. Illustrative of these colloids are proteins, e.g. gelatin; protein derivatives; cellulose derivatives; polysaccharides such as starch; sugars, e.g. dextran; plant gums; etc.; synthetic polymers such as polyvinyl alcohol, polyacrylamide, and polyvinylpyrrolidone; and other suitable hydrophillic colloids such as are disclosed in U.S. Pat. No. 3,297,446. Mixtures of the aforesaid colloids may be used, if desired.

In the practice of this invention, various types of photographic supports may be used to prepare the photographic elements. Suitable supports include film base (e.g. cellulose nitrate film, cellulose acetate film, polyvinyl acetal film, polycarbonate film, polystyrene film, polyethylene terephthalate film and other polyester films), paper, glass, cloth, and the like. Paper supports coated with alpha-olefin polymers, as exemplified by polyethylene and polypropylene, or with other polymers, such as cellulose organic acid esters and linear polyesters, can also be used if desired. Supports that have been coated with various layers and dried are also suitable. The support can be in the form of a continuous web or in the form of discrete sheets. However, in commercial practice, a continuous web is generally used.

The method of the present invention can be used either to design compositions for coating on a moving web or to adjust existing compositions that exhibit ripple once coated as a layered mass on the moving web. If ripple imperfections are detected in the layered mass, one or more conditions for the coating of the compositions, including critical viscosity $\mu$, critical density $\rho$, speed $V_W$ of the moving web, total vertical web distance $L_{VT}$ of the web path, and total thickness of the layered mass $d_T$, can be adjusted to reduce ripple value X. The greater the reduction of ripple value X, the greater the reduction of the ripple severity. Preferably, ripple value X is reduced to less than about 35 according to the formula above. Most preferably, ripple value X is reduced to less than 20. In accordance with the adjusted conditions, a laminar flow of the layered mass is formed and then received as a layered coating on the moving web.

In another embodiment of the present method, the likelihood of ripple imperfections occurring can be predicted before the plurality of layers is coated on the moving web. In this embodiment of the present method, proposed coating compositions for a layered mass including upper, middle, and lower layers to be received by a moving web are defined. The density and viscosity values of each layer are measured and the critical density and critical viscosity are determined. The anticipated total thickness of the layered mass, the web speed, and the total vertical distance of the web path are also determined. The ripple value X is then calculated according to the formula described above using the measured and determined values. If the ripple value is greater than 75, then ripple imperfections are likely to occur in the subject coating operation. If it is found that ripple imperfections are likely to occur, any one or more of the coating conditions including the critical viscosity, critical density, web speed, total vertical web distance, and total thickness of the layered mass, can be adjusted to lower the ripple value to, preferably to less than 35, and reduce the likelihood of formation of ripple imperfections.

The invention is further illustrated by the following examples.

EXAMPLES

Coating compositions for a three-layer coating pack were prepared. The compositions contained water, surfactant, viscosifying agent, and gelatin. The prepared coating packs were bead coated onto a continuous polyethylene terephthalate web using a three- or four-slot slide hopper. The web path was nominally vertical.

Layer viscosities were adjusted using variable amounts of gelatin and a viscosifying agent. The weight percentage of gelatin in a given layer ("gel %") was used to quantify the gelatin concentration in a given layer. In each sample, the viscosity of each composition as delivered to the web was nominally equal. Upon coating, the differing gelatin concentrations of the compositions resulted in water diffusion from layers of low gelatin concentration to layers of high gelatin concentration. This water diffusion between the thin coated layers led to a new viscosity profile in the coated plurality of layers. The viscosifying agent used to adjust the viscosity of various layers was a potassium salt of octadecyl hydroquinone sulfonate.

5–12 ml of TRITON X-200 (a sodium salt of octylphenoxydiethoxyethane sulfonate sold by Union Carbide), was added was added per pound of gelatin solution as a surfactant. Surfactant was added to the top layer only. To obtain optical density to facilitate visual observation of the ripple imperfection, a carbon dispersion was added either to the middle layer (Example 4) or as a 0.0024 centimeter portion of the bottom layer adjacent to the middle layer (Examples 1–3). Dried coating samples were obtained for both visual and numerical quantification. The layers were isothermally coated on the web at 105° F. All viscosities were also measured at 105° F.

Black toner particles of approximately 13 micron diameter were introduced into the middle layer of the three-layer system in an effort to introduce hydrodynamic disturbances of known size into the system. Such disturbances are known to induce localized wave formation in the vicinity of the particles and aided in the identification of ripple susceptibility.

Digital images of the coated samples were made using a charge-coupled device ("CCD") camera and were analyzed for the presence of ripple imperfections. FIGS. 1A–1E, 2A–2E, 3A–3E, and 4A–4E are magnifications of samples of the coated web. FIGS. 1A–1E, 3A–3E and 4A–4E are 5× magnifications of a 1.0 cm sample of the coated web. FIGS. 2A–2E are 12.5× magnifications of a 0.4 cm sample of the coated web. Wave-form analyses were performed on the digitized images. A lengthwise spatial Fast Fourier Transform (FFT) was performed to provide a measure of the percentage of optical density variation ("%OD") in the carbon-bearing layer over a range of wavelengths. The measured variations in optical density were directly proportional to variations in thickness of the layer bearing the carbon dispersion, and were proportional to the spectral distribution of wave amplitudes in the coating samples. For the purposes of quantifying ripple severity, it was convenient to quantify each experimental %OD variation vs. wavelength spectrum by one number. To do so, the average %OD variation was calculated over a wavelength range containing the wavelength having the largest wave amplitude. This average is a measure of the ripple severity and is termed "Nonuniformity".

EXAMPLE 1

Three coating compositions were prepared according to the procedure outlined above. The total thickness of the three-layer mass prepared using the coating compositions was varied. In each sample, the middle layer was 4.8 % of the total pack thickness. The upper and lower layer thicknesses were equal at 47.6 % of the total pack thickness.

The total pack thickness was $5\times10^{-3}$ cm in Sample 1 and increased $2.48\times10^{-3}$ cm per sample up to a thickness of $2.48\times10^{-2}$ cm in Sample 10.

The gelatin concentration of layers 1 and 3 was 7.0 weight percent and layer 2 was 13 weight percent in each sample. Layers 1 and 3 of each sample contained 1.75 g viscosifying agent per pound of melt. As delivered, the viscosity of each layer was 35 centipoise ("cP"). Each of the samples, therefore, had a relatively low viscosity middle layer after coating and diffusion occurred. The three layers were simultaneously bead coated on the web at a coating speed of 55 feet/minute. The incline residence time was 2.8 seconds.

The experimental coating conditions and results are outlined in Table I below where NU is nonuniformity, and X is the ripple value. The results are illustrated by FIGS. 1A through 1E. The sample corresponding to each figure is indicated in the "SAMPLE" column.

TABLE I

| SAMPLE | $d_T$ (μm) | NU | $Log_e$[NU] | X |
|---|---|---|---|---|
| 1(1A) | 50 | 0.268 | −1.32 | 19 |
| 2 | 74 | 0.675 | −0.416 | 29 |
| 3 | 99 | 0.723 | −0.324 | 38 |
| 4(1B) | 124 | 0.612 | −0.491 | 48 |
| 5(1C) | 149 | 1.843 | +0.611 | 58 |
| 6 | 174 | 1.392 | +0.331 | 67 |
| 7(1D) | 198 | 2.563 | +0.941 | 77 |
| 8 | 223 | 3.537 | +1.263 | 86 |
| 9(1E) | 248 | 4.491 | +1.502 | 96 |

As illustrated by FIG. 1, as total pack thickness increases, nonuniformity increases. Significant ripple formation was not observed until Sample 5 (FIG. 1C) which had a ripple value X of 58. Sample 1 (FIG 1A) had a ripple value X of 19 and evidenced virtually no ripple formation. Therefore, FIGS. 1 through 1E indicate that as total pack thickness increases, ripple formation increases.

EXAMPLE 2

Coating compositions were prepared according to Example 1 except that in each sample the gelatin concentration of the upper and lower layers was 13.0 weight percent and the gelatin concentration of the middle layer was 7.0 weight percent. Also, the middle layer in each sample contained 2.0 g of viscosifying agent per pound of melt. As delivered, the viscosity of each layer was 35 cP. The middle layer of each sample had a relatively high viscosity after it was coated on the web and diffusion driven by gelatin concentration differences took place.

The experimental coating conditions and results are outlined in Table II below. The results are illustrated by FIGS. 2A through 2E. The sample corresponding to each figure is indicated in the "SAMPLE" column.

TABLE II

| SAMPLE | PACK THICKNESS (μm) | NU | $Log_e$ (NU) | X |
|---|---|---|---|---|
| 10(2A) | 50 | 0.206 | −1.580 | 19 |
| 11 | 74 | 0.343 | −1.070 | 29 |
| 12(2B) | 99 | 0.367 | −1.002 | 38 |
| 13 | 124 | 0.363 | −1.013 | 48 |
| 14(2C) | 149 | 0.746 | −0.293 | 58 |

TABLE II-continued

| SAMPLE | PACK THICKNESS (μm) | NU | $Log_e$ (NU) | X |
|---|---|---|---|---|
| 15 | 174 | 0.840 | −0.174 | 67 |
| 16(2D) | 198 | 0.942 | −0.060 | 77 |
| 17 | 223 | 2.276 | +0.822 | 86 |
| 18(2E) | 248 | 2.194 | +0.786 | 96 |

Figure 1C:
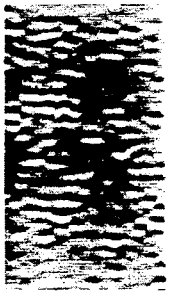
Figure 1D:
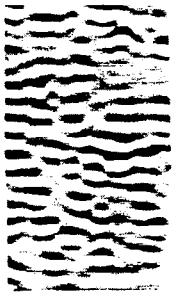
Figure 1E:
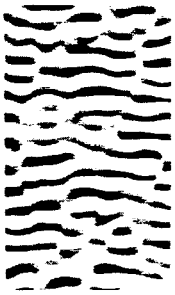
Figure 2:
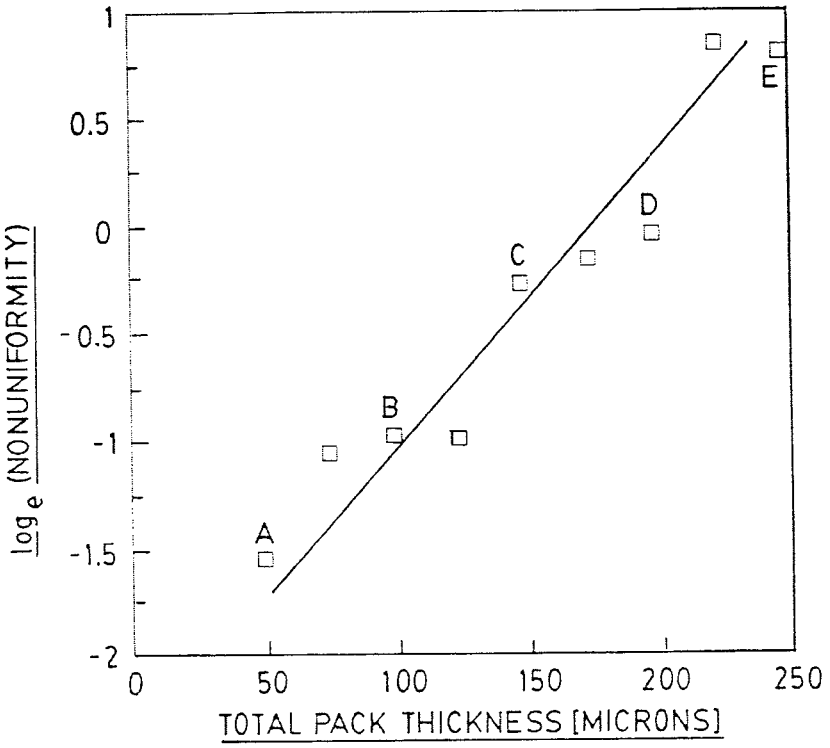
FIG. 2 is a graph illustrating the effect of total coating pack thickness on ripple severity for a three layer coating pack having a high viscosity middle layer.
Figures 2A, 2B, 2C, 2D, 2E:
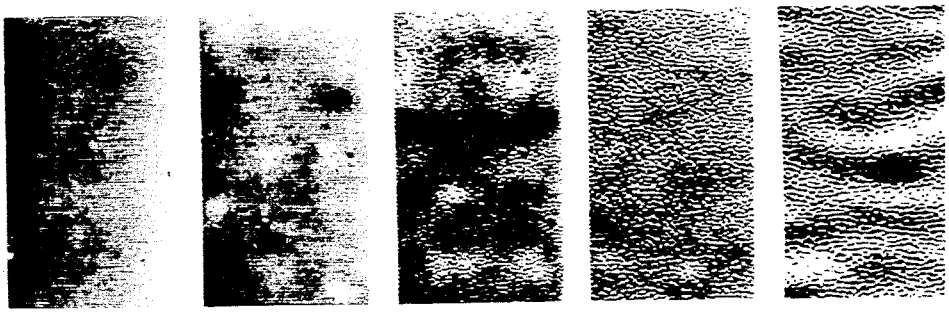
FIGS. 2A, 2B, 2C, 2D, and 2E are a series of photomicrographs illustrating the effect of total coating pack thickness on ripple severity for a three layer coating pack having a high viscosity middle layer.

As illustrated by FIG. 2, as total pack thickness increases, nonuniformity increases. Significant ripple formation was not observed until Sample 14 (FIG. 2C) which had a ripple value X of 58. Sample 10 (FIG. 2A) had a ripple value X of 19 and evidenced virtually no ripple formation. Therefore, FIGS. 2 through 2E indicate that as total pack thickness increases, ripple formation increases. In addition, a comparison of the wavelengths of the waves as illustrated by FIGS. 2C–2E with the waves illustrated in FIGS. 1C–1E shows that the viscosity profile of the plurality of layers after coating can be determined by observing the wavelength of the waves formed. In FIGS. 1C–1E (low viscosity middle layers) the wavelength maximums were from about 0.05–0.08 cm, while the waves in FIGS. 2C–2E (high viscosity middle layers) were from about 0.005–0.009 cm. Therefore, Examples 1 and 2 also show that a ripple-prone coating pack with a low viscosity middle layer will exhibit ripple waves with a relatively longer wavelength while a ripple-prone coating pack with a high viscosity middle layer will exhibit ripple waves with a relatively smaller wavelength. Generally, ripple waves seen in coating packs with low viscosity middle layers have a wavelength approximately four times the total pack thickness. Ripple waves observed in coating packs with high viscosity middle layers typically have a wavelength approximately 0.4 times the total pack thickness.

EXAMPLE 3

Coating compositions for the upper, middle, and lower layers of a three-layer coating pack were prepared according to Example 1 except that the coating speeds were varied to alter the effective inclined residence time ("res. time") of the layered mass on the moving web. Also, in each sample the wet thickness of the middle layer was 0.00071 cm and the total wet thickness of the coating pack was 0.015 cm.

The experimental coating conditions and results are outlined in Table III below. The results are illustrated in FIGS. 3A through 3E. The sample corresponding to each figure is indicated is the "SAMPLE" column.

TABLE III

| SAMPLE | COATING SPEED (feet/min) | RES. TIME (sec.) | NU | $Log_e$(NU) | X |
|---|---|---|---|---|---|
| 19(3E) | 40 | 3.9 | 5.906 | +1.776 | 80 |
| 20 | 45 | 3.4 | 3.577 | +1.274 | 70 |
| 21 | 50 | 3.1 | 3.568 | +1.272 | 64 |
| 22 | 55 | 2.8 | 4.238 | +1.444 | 58 |
| 23(3D) | 75 | 2.6 | 2.707 | +0.996 | 53 |
| 24 | 65 | 2.4 | 2.410 | +0.880 | 49 |
| 25 | 70 | 2.2 | 2.042 | +0.714 | 45 |
| 26(3C) | 75 | 2.1 | 1.811 | +0.594 | 43 |
| 27 | 80 | 1.9 | 1.746 | +0.557 | 39 |
| 28 | 85 | 1.8 | 1.839 | +0.609 | 37 |
| 29(3B) | 90 | 1.7 | 1.080 | +0.077 | 35 |
| 30 | 100 | 1.6 | 0.755 | −0.503 | 33 |
| 31 | 110 | 1.4 | 0.615 | −0.486 | 29 |
| 32(3A) | 120 | 1.3 | 0.491 | −0.711 | 27 |
| 33 | 130 | 1.2 | 0.343 | −1.070 | 25 |
| 34 | 140 | 1.1 | 0.356 | −1.033 | 23 |

TABLE III-continued

| SAMPLE | COATING SPEED (feet/min) | RES. TIME (sec.) | NU | $Log_e$(NU) | X |
|---|---|---|---|---|---|
| 35 | 150 | 1.0 | 0.544 | −0.609 | 21 |
| 36 | 175 | 1.0 | 0.294 | −1.224 | 21 |
| 37 | 170 | 0.9 | 0.371 | −0.992 | 18 |
| 38 | 180 | 0.9 | 0.273 | −1.298 | 18 |

Figure 3:
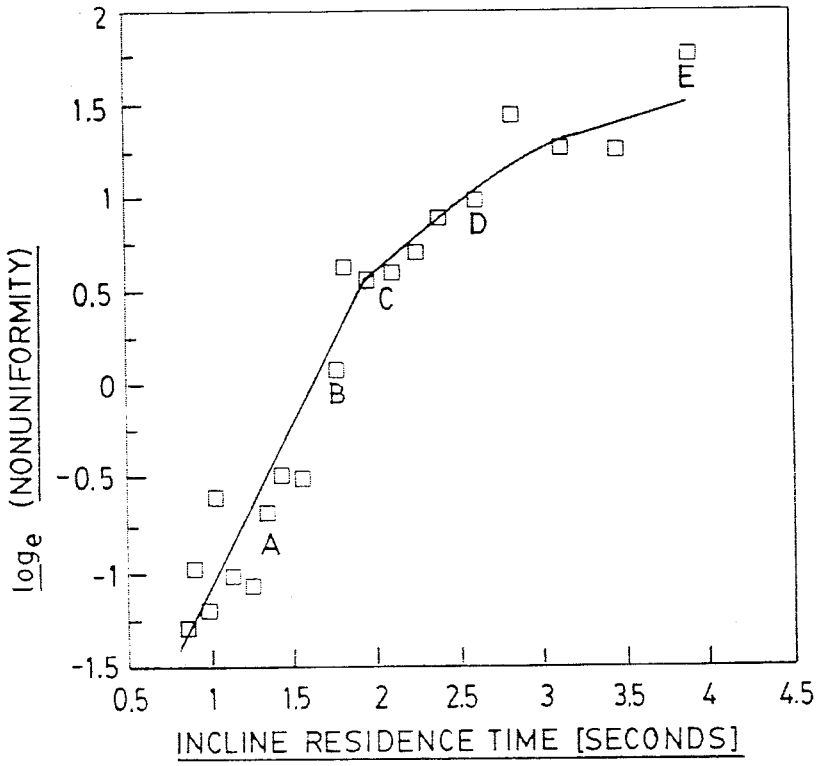
FIG. 3 is a graph illustrating the effect of incline residence time on ripple severity.
Figure 3A:
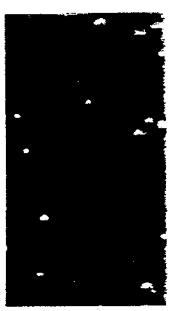
FIGS 3A, 3B, 3C, 3D, and 3E are a series of photomicrographs illustrating the effect of incline residence time on ripple severity.
Figure 3B:
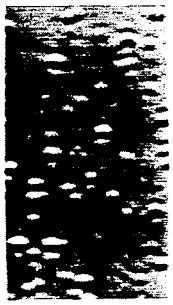
Figure 3C:
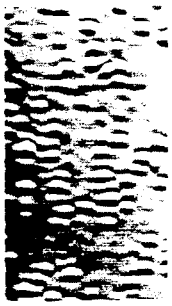
Figure 3D:
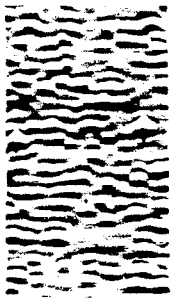
Figure 3E:
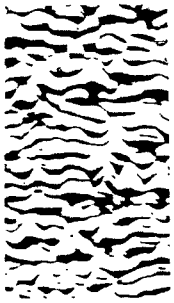

FIG. 3 indicates that as the time the layered mass spends on the vertical web path decreases, the nonuniformity decreases. Significant ripple formation was not observed until Sample 26 (FIG. 3C) which had a ripple value X of 43. Samples 29 (FIG. 3B) and 32 (FIG. 3A) had ripple values X of 35 and 27, respectively, and evidenced virtually no ripple formation. Therefore, FIG. 3A–3E indicate that as the time the layered mass spends on the vertical web path decreases, ripple severity decreases.

EXAMPLE 4

Coating compositions for the upper, middle, and lower layers of a three-layer coating pack were prepared according to the procedure outlined above except that the viscosity of the layers was changed to alter the critical viscosity. Increasing amounts of viscosifying agent were added to each layer of each sample to increase their viscosity. The critical viscosities of the samples were measured before the layers were coated on the coating pack. The gelatin concentration of the upper and lower layers in each sample was 7.0 weight percent. The gelatin concentration of the middle layer in each sample was 11.0 weight percent. The viscosity of each layer in the coating pack was the same for each sample. The effective inclined residence time was 2.1 seconds.

The results are outlined in Table IV below and illustrated in FIGS. 4A through 4E. The sample corresponding to each figure is indicated in the "SAMPLE" column.

TABLE IV

| SAMPLE | CRIT. VISC. (cP) | NU | $Log_e$(NU) | X |
|---|---|---|---|---|
| 39(4E) | 35 | 3.761 | +1.325 | 43 |
| 40(4D) | 50 | 2.497 | +0.915 | 30 |
| 41(4C) | 64 | 1.277 | +0.245 | 24 |
| 42(4B) | 77 | 0.430 | −0.844 | 20 |
| 43(4A) | 125 | 0.375 | −0.981 | 12 |

Figure 4:
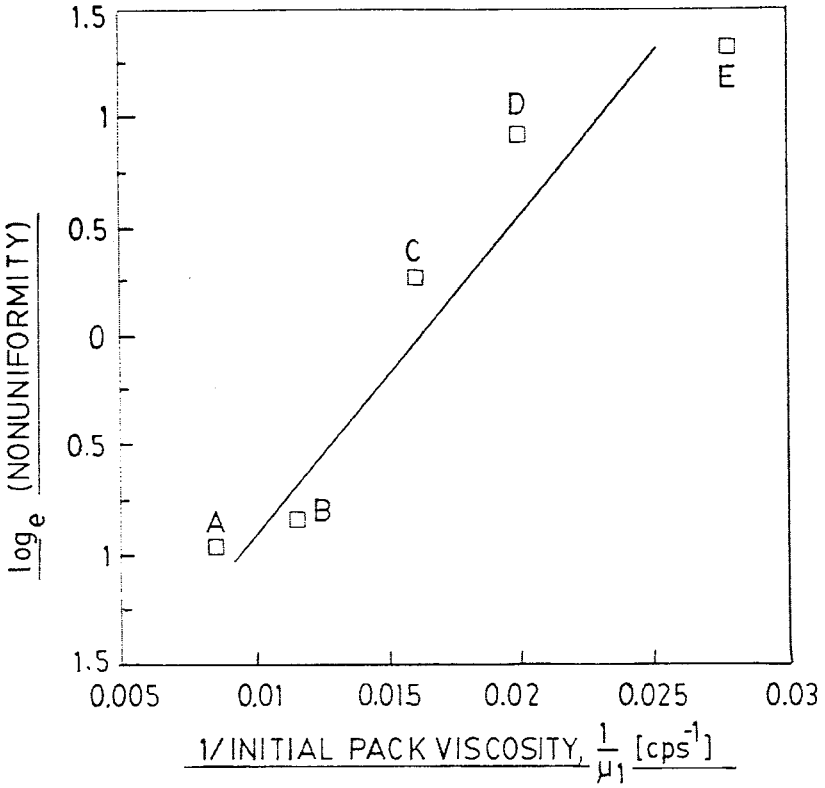
FIG. 4 is a graph illustrating the effect of initial coating pack viscosity on ripple severity.
Figure 4A:
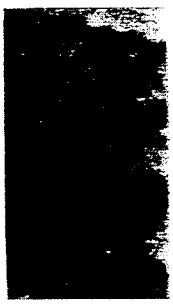
FIGS. 4A, 4B, 4C, 4D, and 4E are a series of photomicrographs illustrating the effect of initial coating pack viscosity on ripple severity.
Figure 4B:
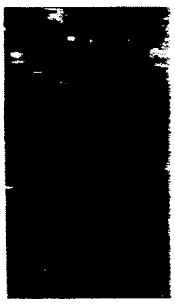
Figure 4C:
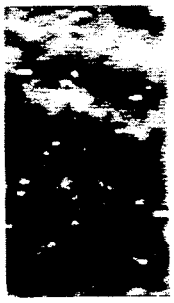
Figure 4D:
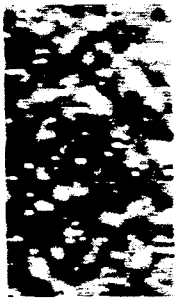
Figure 4E:
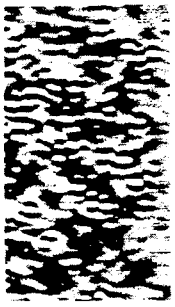

FIG. 4 indicates that as the critical viscosity of the pack increases, nonuniformity decreases. Significant ripple formation was not observed until Sample 39 (FIG. 4E) which had a ripple value X of 43. Samples 40 (FIG. 4D), 41 (FIG. 4C), 42 (FIG. 4B), and 43 (FIG. 4A) all had ripple values X of less than 35 and evidenced virtually no ripple formation. Therefore, FIGS. 4A–4E indicate that as the critical viscosity of the pack increases the severity of ripple formation decreases.

The invention has been described in detail with particular reference to certain preferred embodiments thereof, but it will be understood that variations and modifications can be effected within the spirit and scope of the invention as described hereinabove and as define in the appended claims.

What is claimed is:

1. A method for reducing the tendency toward the formation of ripple imperfections in the coating of a plurality of layers of liquid photographic compositions on a moving web which follows a path from a coating application point to a set point and where said web path has a vertical component not equal to zero, comprising the steps of:

determining conditions for aid coating of said compositions in accordance with the formula:

$$X = \frac{(\rho)(g)(d_T)(L_{VT})}{2\mu(V_w)}$$

wherein X is a ripple value and is less than 35 and wherein $\rho$ is the critical density of said plurality of layers, g is a constant representing the acceleration due to gravity, $d_T$ is the total thickness of said plurality of layers, $L_{VT}$ is the total vertical distance of said web path, $\mu$ is the critical viscosity of said plurality of layers, and $V_w$ is the speed of said moving web;

in accordance with said determined conditions, forming a laminar flow of said plurality of layers which includes said compositions as middle, upper, and lower layers, said middle layer contiguous with both said upper layer and said lower layer; and receiving said plurality of layers as a layered mass on said moving web at said coating application point.

2. A method according to claim 1, wherein said coated middle layer has a viscosity on said web greater than about 1.5 times the viscosity of both said upper and lower layers.

3. A method according to claim 1, wherein said coated middle layer has a viscosity on said web less than about 0.8 times the viscosity of both said upper and lower layers.

4. A method according to claim 1, wherein said ripple value X is less than 20.

5. A method according to claim 1, wherein at least one of said upper, middle, and lower layers includes silver halide photographic material and gelatin.

6. A method according to claim 5, wherein said conditions include adding rheology-modifying agents to one or more of said compositions to increase said $\mu$.

7. A method according to claim 5, wherein said web is a photographic support selected from the group consisting of cellulose nitrate, cellulose acetate, polyvinyl acetal, polycarbonate, polystyrene, polyethylene terephthalate, paper, resin-coated paper, glass, and cloth.

8. A method according to claim 5, wherein said forming is on an inclined plane and said receiving comprises establishing a free falling vertical curtain from said plurality of layers between said inclined plane and said coating application point, wherein said curtain extends transversely of said web path and impinges on said moving web.

9. A method according to claim 5, wherein said forming is on an inclined plane and said receiving is by establishing a bead of said plurality of layers between said inclined plane and said moving web, whereby said plurality of layers is simultaneously picked up by said moving web.

10. A method according to claim 5, wherein said ripple value X is less than 20.

11. A method according to claim 1, wherein said determining comprises:

measuring a density value and a viscosity value for said upper, middle, and lower layers and determining a highest density value $\rho$ and a lowest viscosity value $\mu$;

determining a total vertical web distance $L_{VT}$ for said web path;

determining the speed $V_w$ of said moving web;

determining the total thickness $d_T$ of said layered mass; and calculating a ripple value X according to a formula as follows:

$$X = \frac{(\rho)(g)(d_T)(L_{VT})}{2\mu(V_w)}$$

wherein g is a value representing acceleration due to gravity;

adjusting any one or more variables selected from the group consisting of said lowest density value $\rho$, said lowest viscosity value $\mu$, said total vertical web distance $L_{VT}$, said web speed $V_w$, and said total thickness $d_T$ of said layered mass in a manner effective to reduce said ripple value X to a value less than 35.

12. A method according to claim 11, wherein said ripple value X is less than 20.

13. A method for reducing the tendency toward the formation of ripple imperfections in the coating of a multilayer photographic element comprising the steps of:

preparing coating compositions for a layered mass including upper, middle, and lower layers to be received by a moving web which follows a path from a coating application point to a set point and where said web path has a vertical component not equal to zero, said layered mass having a ripple value X according to the formula as follows:

$$X = \frac{(\rho)(g)(d_T)(L_{VT})}{2\mu(V_w)}$$

wherein $\rho$ is the critical density of said plurality of layers, g is a constant representing the acceleration due to gravity, $d_T$ is the total thickness of said plurality of layers, $L_{VT}$ is the total vertical distance of said web path, $\mu$ is the critical viscosity of said plurality of layers, and $V_w$ is the speed of said moving web;

detecting said ripple imperfections in said layered mass;

adjusting one or more conditions for the coating of said compositions to reduce said ripple imperfections, including critical viscosity $\mu$, critical density $\rho$, speed $V_w$ of said moving web, total vertical web distance $L_{VT}$ of said web path, and total thickness of said layered mass $d_T$, to reduce said ripple value X;

and, in accordance with said adjusted conditions, forming a laminar flow of said layered mass which includes said compositions as layers, said middle layer contiguous to said upper and lower layers; and receiving said layered mass as a layered coating on said moving web at said coating application point.

14. A method according to claim 13, wherein said ripple value X is reduced to a value less than 35.

15. A method according to claim 13, wherein said ripple value X is reduced to a value less than 20.

16. A method for predicting the tendency toward the formation of ripple imperfections in the coating of a multilayer photographic element comprising the steps of:

defining proposed coating compositions for a layered mass including upper, middle, and lower layers to be received by a moving web which follows a path from a coating application point to a set point and where said web path has a vertical component not equal to zero;

determining a density value and a viscosity value for said upper, middle, and lower layers and determining a critical density value $\rho$ of said plurality of layers and a critical viscosity value $\mu$ of said plurality of layers;

determining a total vertical web distance $L_{VT}$ for said web path;

determining the speed $V_w$ of said moving web;

determining the total thickness $d_T$ of said layered mass; and determining is a ripple value X is greater than 75 according to the formula as follows:

$$X = \frac{(\rho)(g)(d_T)(L_{VT})}{2\mu(V_w)}$$

wherein g is a value representing acceleration due to gravity;

adjusting one or more conditions for the coating of said compositions to reduce said ripple value X to a value less than 75, said conditions including critical viscosity $\mu$, critical density $\rho$, speed $V_w$ of said moving web, total vertical web distance $L_{VT}$ of said web path, and total thickness of said layered mass $d_T$, to reduce said ripple value X;

and, in accordance with said adjusted conditions, forming a laminar flow of said layered mass which includes said compositions as layers, said middle layer contiguous to said upper and lower layers; and receiving said layered mass as a layered coating on said moving web at said coating application point.

* * * * *